US008971557B2

(12) United States Patent
Xia et al.

(10) Patent No.: US 8,971,557 B2
(45) Date of Patent: Mar. 3, 2015

(54) BINAURALLY COORDINATED COMPRESSION SYSTEM

(71) Applicant: Starkey Laboratories, Inc., Eden Prairie, MN (US)

(72) Inventors: Jing Xia, Berkeley, CA (US); Olaf Strelcyk, Oakland, CA (US); John Andrew Dundas, Minneapolis, MN (US); Sridhar Kalluri, El Cerrito, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/962,762

(22) Filed: Aug. 8, 2013

(65) Prior Publication Data

US 2014/0044291 A1 Feb. 13, 2014

Related U.S. Application Data

(60) Provisional application No. 61/681,408, filed on Aug. 9, 2012.

(51) Int. Cl.
*H04R 25/00* (2006.01)

(52) U.S. Cl.
USPC ..... 381/321

(58) Field of Classification Search
USPC ..... 381/312, 313, 315–316, 320–32.1
See application file for complete search history.

(56) References Cited

U.S. PATENT DOCUMENTS

| | | | | |
|---|---|---|---|---|
| 2004/0190734 | A1 | 9/2004 | Kates | |
| 2010/0002886 | A1 | 1/2010 | Doclo et al. | |
| 2010/0172506 | A1 * | 7/2010 | Iwano | 381/313 |
| 2011/0069851 | A1 * | 3/2011 | Kjems et al. | 381/313 |
| 2011/0249823 | A1 | 10/2011 | Thomsen et al. | |
| 2012/0008807 | A1 | 1/2012 | Gran | |
| 2012/0195449 | A1 * | 8/2012 | Thiede et al. | 381/315 |
| 2013/0170654 | A1 * | 7/2013 | Ell et al. | 381/312 |
| 2013/0308804 | A1 * | 11/2013 | Meskens | 381/315 |

OTHER PUBLICATIONS

"European Application U.S. Appl. No. 13179959.5, Extended European Search Report mailed 10-07-13", 4 pgs.

* cited by examiner

*Primary Examiner* — Suhan Ni
(74) *Attorney, Agent, or Firm* — Schwegman Lundberg & Woessner, P.A.

(57) ABSTRACT

A hearing assistance system includes a pair of hearing aids performing dynamic range compression while preserving spatial cue to provide a hearing aid wearer with satisfactory listening experience in complex listening environments. In various embodiments, the dynamic range compression is binaurally coordinated based on number and distribution of sound source(s). In various embodiments, in addition to preserving spatial cue, the dynamic range compression is controlled to optimize audibility and comfortable loudness of target signals.

22 Claims, 5 Drawing Sheets

BINAURALLY COORDINATED COMPRESSION SYSTEM

CLAIM OF PRIORITY

The present application claims the benefit under 35 U.S.C. §119(e) of U.S. Provisional Patent Application Ser. No. 61/681,408, filed on Aug. 9, 2012, which is incorporated herein by reference in its entirety.

FIELD OF THE INVENTION

The present subject matter relates generally to hearing assistance devices, and in particular to a binaurally coordinated compression system that provides compressive gain while preserving spatial cues.

BACKGROUND

Hearing impaired listeners find it extremely hard to understand speech in complex acoustic scenes such as multitalker environments where targets and interferers are often in separate locations. Knowing where to listen makes significant contributions to speech understanding in these situations. Inter-aural level differences (ILDs), which are differences between levels of a sound as perceived in the two ears of a listener, provides for important cues to spatial hearing. Dynamic range compression of audio signal as performed in hearing assistance devices reduces volume of louder sounds while increasing volume of softer sounds. Dynamic range compression operating independently at the ears reduces ILDs, by providing more gain to the softer sound at one ear and less gain to the louder sound at the other ear. There is a need for providing compressive gain and simultaneously preserving ILD spatial cue in multitalker backgrounds.

SUMMARY

A hearing assistance system includes a pair of hearing aids performing dynamic range compression while preserving spatial cue to provide a hearing aid wearer with satisfactory listening experience in complex listening environments. In various embodiments, the dynamic range compression is binaurally coordinated based on number and distribution of sound source(s). In various embodiments, in addition to preserving spatial cue, the dynamic range compression is controlled to optimize audibility and comfortable loudness of target signals.

In one embodiment, a method for operating a pair of first and second hearing aids is provided. A first dynamic range compression, including applying a first gain to a first audio signal, is performed in the first hearing aid. A second dynamic range compression, including applying a second gain to a second audio signal, is performed in the second hearing aid. An acoustic scene is detected. The first dynamic range compression and the second dynamic range compression are controlled using the detected acoustic scene, such that the first dynamic range compression and the second dynamic range compression are performed independently in response to the detected acoustic scene indicating a single sound source and coordinated, in response to the detected acoustic scene indicating a plurality of sound sources, using a distribution of sound sources of the plurality of sound sources indicated by the detected acoustic scene.

In one embodiment, a hearing assistance system for use by a listener includes a first hearing aid and a second hearing aid. The first hearing aid is configured to receive a first audio signal and perform a first dynamic range compression of the first audio signal. The second hearing aid is configured to receive a second audio signal and perform a second dynamic range compression of the second audio signal. Control circuitry of the first and second hearing aids is configured to detect an acoustic scene using the first and second audio signals and control the first dynamic range compression and the second dynamic range compression using the detected acoustic scene, such that the first dynamic range compression and the second dynamic range compression are performed independently in response to the detected acoustic scene indicating a single sound source and coordinated, in response to the detected acoustic scene indicating a plurality of sound sources, using a distribution of sound sources of the plurality of sound sources indicated by the detected acoustic scene.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses, among other things, a hearing assistance system including a pair of hearing aids in which dynamic range compression is performed while preserving spatial cue. The present subject matter is used in hearing assistance devices to benefit to hearing-impaired listeners in complex listening environments. In various embodiments, the present subject matter aids communication in a broad range of multi-source scenarios (symmetric and asymmetric as seen from a listener's point of view) by improving binaural spatial release, spatial focus of attention, and better-ear listening. In various embodiments, this is achieved by preserving ILD spatial cue and optimizing the audibility as well as comfortable loudness of target signals, among other things.

Figure 1:
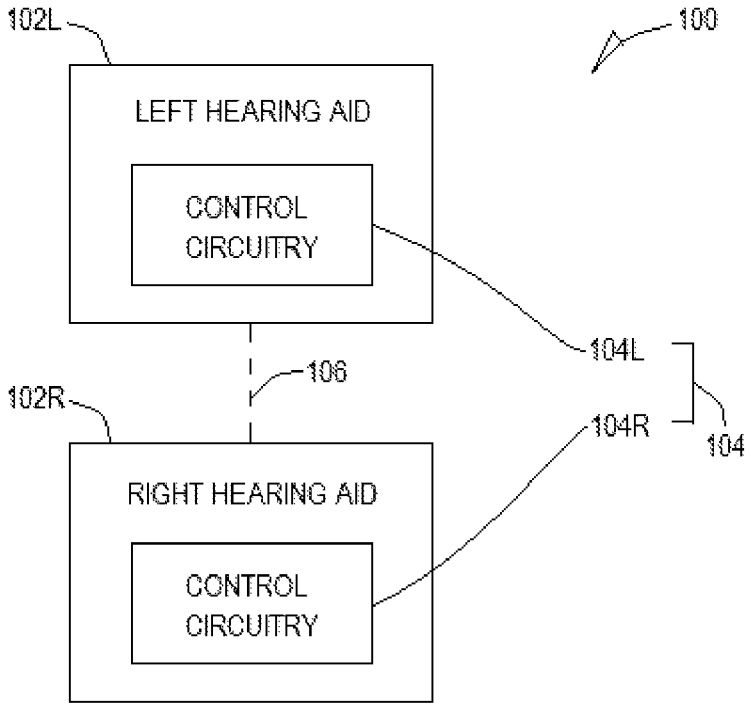
FIG. 1 is a block diagram illustrating an embodiment of a hearing assistance system.

FIG. 1 is a block diagram illustrating an embodiment of a hearing assistance system 100. Hearing assistance system 100 includes a left hearing aid 102L for delivering sounds to a listener's left ear and a right hearing aid 102R for delivering sounds to the listener's right ear. While hearing aids are discussed in this document as an example, the present subject matter is applicable to any binaural audio devices.

Left hearing aid 102L is configured to receive a first audio signal and perform a first dynamic range compression of the first audio signal. Right hearing aid 102R is configured to receive a second audio signal and perform a second dynamic range compression of the second audio signal. Hearing assistance system 100 includes control circuitry 104, which includes first portions 104L in left hearing aid 102L and second portions 104R in right hearing aid 102R. Control circuitry 104 is configured to detect an acoustic scene using the first and second audio signals and control the first dynamic range compression and the second dynamic range compression using the detected acoustic scene. In various embodiments, the acoustic scene (listening environment) may indicate the number of sound source(s) being present in the detectable range of hearing aids 102L and 102R and/or spatial distribution of the sound source(s), such as whether the sound sources are symmetric about a midline between left hearing aid 102L and right hearing aid 102R (i.e., symmetric about the listener). In various embodiments, the sound sources include source of target speech (sound intended to be heard by the listener) and interfering noise sources, and the acoustic scene may indicate the locations of the noise sources relative to the listener and the location of the source of target speech. In various embodiments, control circuitry 104 is configured to control the first dynamic range compression and the second dynamic range compression such that the first dynamic range compression and the second dynamic range compression are performed independently in response to the detected acoustic scene indicating a single sound source (i.e., a single-source scene), and the first dynamic range compression and the second dynamic range compression are coordinated in response to the detected acoustic scene indicating a plurality of sound sources (i.e., a multi-source scene). In multi-source acoustic scenes, the first dynamic range compression and the second dynamic range compression are coordinated based on the distribution of the sound sources, such that in a symmetric environment, spatial cue is preserved and in an asymmetric environment, noise in the better ear (the ear receiving the audio signal with the better signal-to-noise ratio) is reduced. In one embodiment, audibility and comfortable loudness of the aided signals are also taken into account.

A binaural link 106 communicatively couples between first portion 104L and second portion 104R of control circuitry 104. In various embodiments, binaural link 106 includes a wired or wireless communication link providing for communications between left hearing aid 102L and right hearing aid 102R. In various embodiments, binaural link 106 may include an electrical, magnetic, electromagnetic, or acoustic (e.g., bone conducted) coupling. In various embodiments, control circuitry 104 may be structurally and functionally divided into first portion 104L and second portion 104R in various ways based on design considerations as understood by those skilled in the art.

Figure 2:
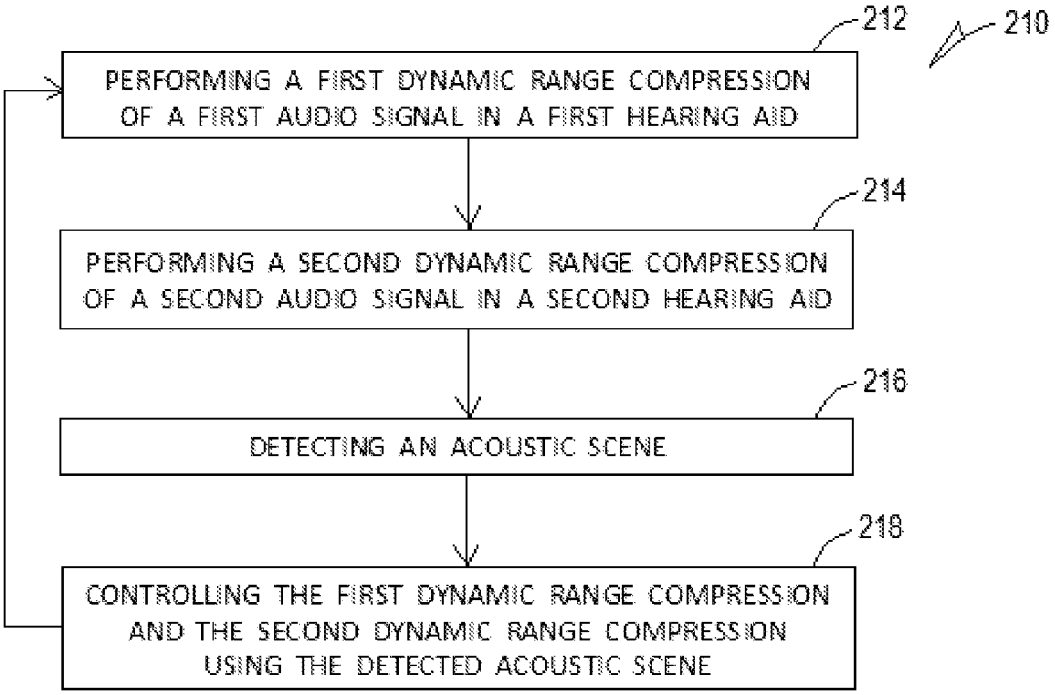
FIG. 2 is a flow chart illustrating an embodiment of a method for dynamic range compression performed in the hearing assistance system.

FIG. 2 is a flow chart illustrating an embodiment of a method 210 for dynamic range compression performed in a hearing assistance system including a pair of hearing aids, such as hearing assistance system 100 including hearing aids 102L and 102R. For the purpose of discussion, the hearing aids are referred to as a first hearing aid and a second hearing aid. In various embodiments, either one of the first and second hearing aids may be configured as left hearing aid 102L, and the other configured as right hearing aid 102R. In one embodiment, control circuitry 104 is configured to perform method 210.

At 212, a first dynamic range compression of a first audio signal is performed in the first hearing aid. At 214, a second dynamic range compression of a second audio signal is performed in the second hearing aid. In various embodiments, the first dynamic range compression includes applying a first gain to the first audio signal, and the second dynamic range compression includes applying a second gain to the second audio signal. At 216, an acoustic scene is detected. The acoustic scene may be indicative of the number of sound source(s) being present in the detectable range of the first and second hearing aids and/or the spatial distribution of the sound source (s), such as whether the sound sources are symmetric about a midline between the first and second hearing aids. At 218, the first dynamic range compression and the second dynamic range compression are controlled using the detected acoustic scene. In various embodiments, the first dynamic range compression and the second dynamic range compression are performed independently in response to the detected acoustic scene indicating a single sound source, and the first dynamic range compression and the second dynamic range compression are coordinated in response to the detected acoustic scene indicating a plurality of sound sources. In multi-source acoustic scenes (i.e., when the detected scene indicates a plurality of sound sources), the first dynamic range compression and the second dynamic range compression are coordinated based on the distribution of the sound sources, such that in the symmetric environment spatial cue is preserved (when the listener needs to focus on the target sound source in the environment) and in the asymmetric environment, noise in the better ear is reduced (when the listener needs to rely on better-ear listening in the environment). In one embodiment, audibility and comfortable loudness of the aided signals are taken into account.

In one example embodiment, if a single sound source is present in the detectable range of the pair of hearing aids, independent compression in the first and second hearing aids is used to minimize power consumption. If two or more sound sources are present, the compression in the first and second hearing aids is coordinated, i.e., a common gain (also referred to as a linked gain) is applied in the first and second hearing aids. There are different ways to coordinate the gains depending on whether the acoustic scenario (distribution of the two or more sound sources) is symmetric or asymmetric around the midline between the first and second hearing aids. In a symmetric scenario, the present subject matter preserves spatial fidelity and applies the maximally possible gain while not producing uncomfortably loud signals. In the asymmetric scenario, the present subject matter supports better-ear listening (i.e., listening with the ear at which the signal-to-noise ratio of the audio signal produced by the hearing aid is higher) in addition to preserving spatial fidelity. When the level of the better-ear signal is low and the signal-to-noise ratio (SNR) of the better-ear signal is positive, the better-ear gain (i.e., the gain applied to the better-ear signal) is chosen as the common gain in order to ensure that the signal stays above threshold. When the level of the better-ear signal is high or when the signal is dominated by noise (the SNR of the better-ear signal being negative), the minimum gain (i.e., the minimum of the gains applied in the first and second hearing aids) is chosen as the common gain in order to reduce interference in the better ear. Control of the first dynamic range compression and the second dynamic range compression at 218 is further discussed below with reference to FIGS. 3 and 4.

Figure 3:
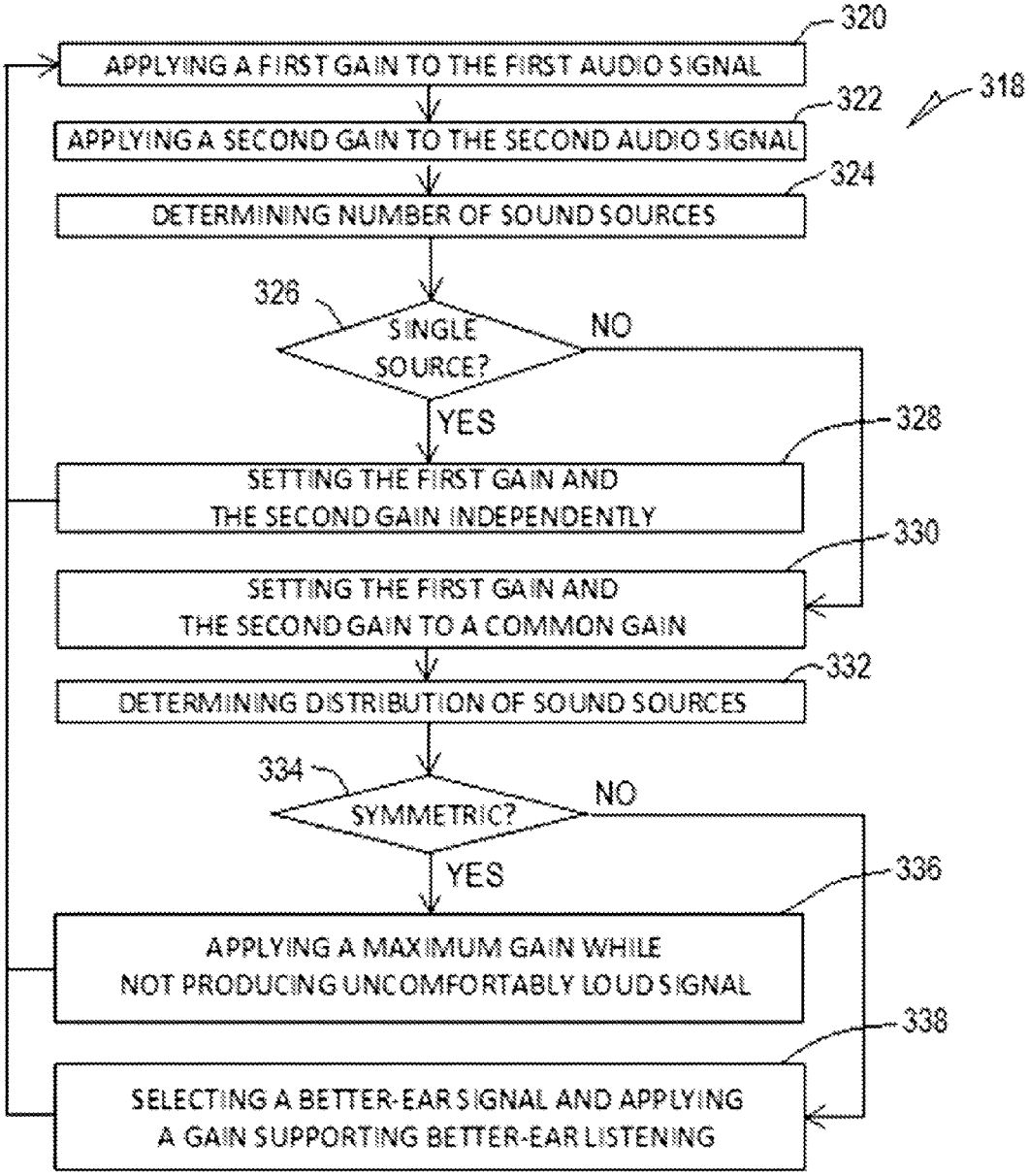
FIG. 3 is a flow chart illustrating an embodiment of a method for controlling the dynamic range compression.

FIG. 3 is a flow chart illustrating an embodiment of a method 318 for controlling the dynamic range compression in hearing aids. Method 318 represents an example embodiment of step 218 in method 210. In one embodiment, control circuitry 104 is configured to perform method 318 as part of method 210.

In the illustrated embodiment, the first dynamic range compression includes applying a first gain to the first audio signal, and the second dynamic range compression includes applying a second gain to the second audio signal. Thus, at 320, the first gain is applied to the first audio signal, and at 322, the second gain is applied to the second audio signal.

At 324, the number of sound sources in the detectable range of the first and second hearing aids as indicated by the detected acoustic scene is determined. At 326, the detected acoustic scene indicates either a single sound source or a plurality of sound sources. In one embodiment, the detection of the acoustic scene at 216 includes determining a first signal-to-noise ratio ($SNR_1$) of the first audio signal and a second signal-to-noise ratio ($SNR_2$) of the second audio signal. $SNR_1$ and $SNR_2$ are then compared to determine whether the minimum of $SNR_1$ and $SNR_2$ exceeds a threshold SNR. In response to the minimum of $SNR_1$ and $SNR_2$ exceeding the threshold SNR, it is declared at 326 that the detected acoustic scene indicates the single sound source. In response to the minimum of $SNR_1$ and $SNR_2$ not exceeding the threshold SNR, it is declared at 326 that the detected acoustic scene indicates the plurality of sound sources. In various embodiments, the threshold SNR may be set to a value equal to or greater than 10 dB, with approximately 15 dB being a specific example.

At 328, the first gain and the second gain are independently set in response to the detected acoustic scene indicating the single sound source at 326. At 330, the first gain and the second gain are set to a common gain in response to the detected acoustic scene indicating the plurality of sound sources at 326.

In various embodiments, the common gain is determined based on the distribution of the sound sources indicated by the detected acoustic scene. At 332, the distribution of the sound sources as indicated by the detected acoustic scene is determined. At 334, the detected acoustic scene indicates either that the distribution of the sound sources is substantially symmetric or that the distribution of the sound sources is substantially asymmetric (about the midline between the first and second hearing aids). In one embodiment, the detection of the acoustic scene at 216 includes determining a first signal-to-noise ratio ($SNR_1$) of the first audio signal and a second signal-to-noise ratio ($SNR_2$) of the second audio signal. The difference between $SNR_1$ and $SNR_2$ is determined and compared to a specified margin. In response to the difference between $SNR_1$ and $SNR_2$ being within the specified margin, it is declared that the distribution of the sound sources is substantially symmetric. In response to the difference between $SNR_1$ and $SNR_2$ exceeding the specified margin, it is declared that the distribution of the sound sources to be substantially asymmetric. In various embodiments, the specified margin may be set to a value between 1 dB and 5 dB, with approximately 3 dB being a specific example.

At 336, a maximum gain is applied while not producing uncomfortably loud signals in response to the detected acoustic scene indicating the distribution of the sound sources being substantially symmetric at 334. At 338, a better-ear signal is selected from the first audio signal and the second audio signal, and the common gain that supports better-ear listening is applied in response to the detected acoustic scene indicating the distribution of the sound sources being substantially asymmetric at 334. In various embodiments, the better-ear signal is selected (in other words, the "better ear" is determined) based on $SNR_1$ and $SNR_2$. The first audio signal is selected to be the better-ear signal in response to $SNR_1$ being greater than $SNR_2$. The second audio signal is selected to be the better-ear signal in response to $SNR_2$ being greater than $SNR_1$. Gains that support better-ear listening are discussed below, with reference to FIG. 4.

Figure 4:
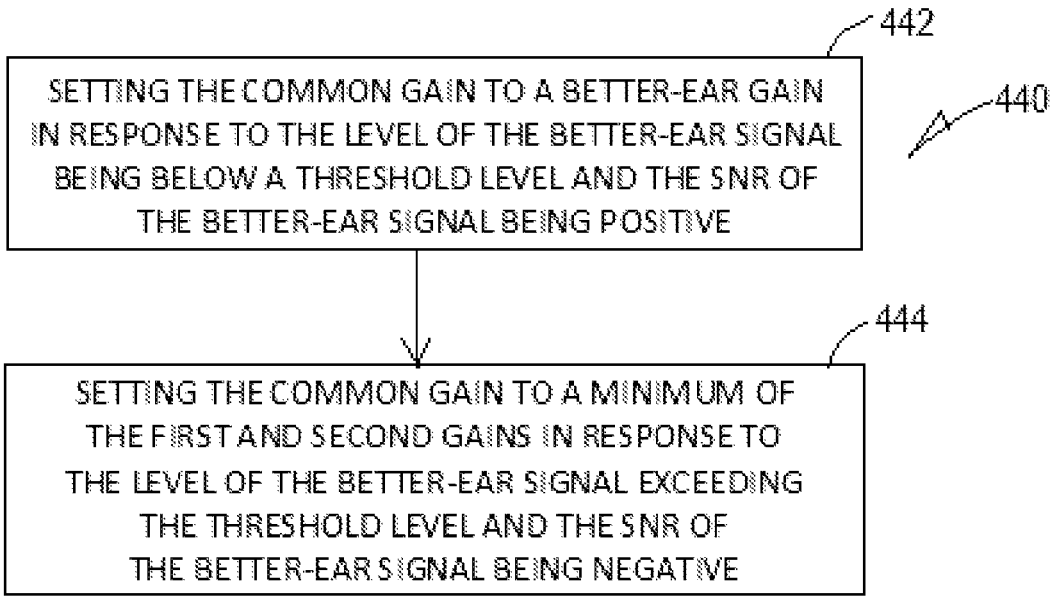
FIG. 4 is a flow chart illustrating an embodiment of a method for supporting better-ear listening in the hearing assistance system.

FIG. 4 is a flow chart illustrating an embodiment of a method 440 for supporting the better-ear listening. Method 440 represents an example embodiment of using a common gain to support better-ear listening as applied in step 338 in method 318. In one embodiment, control circuitry 104 is configured to perform method 440 as part of method 318, which in turn is part of method 210.

In various embodiments, the level of the better-ear signal is determined and compared the level of the better-ear signal to a threshold level. The SNR of the better-ear signal is determined, and whether the SNR is positive or negative is determined. At 442, the common gain is set to a better-ear gain in response to the level of the better-ear signal being below the threshold level and the SNR of the better-ear signal being positive. The better-ear gain is the gain applied to the better-ear signal. In other words, the better-ear gain is one of the first and second gains applied to the one of the first and second signals being selected to be the better-ear signal. If the first audio signal is selected to be the better-ear signal, then the first gain is the better-ear gain. If the second audio signal is selected to be the better-ear signal, then the second gain is the better-ear gain. At 444, the common gain is set to a minimum gain being the minimum of the first and second gains in response to the level of the better-ear signal exceeding the threshold level and the SNR of the better-ear signal being negative. In various embodiments, the threshold level is set to a value between 0 dB SL (Decibels Sensation Level) and 20 dB SL, with approximately 10 dB SL as a specific example.

In various embodiments, the present subject matter uses a binaural link between the left and right hearing aids, such as binaural link 106 between left hearing aid 102L and right hearing aid 102R, to communicate short-term level estimates and long-term SNR estimates. In various embodiments, short-term gain signals are communicated instead of short-term level estimates. Such embodiments apply to symmetric hearing losses since the gain prescriptions can differ strongly between the two ears for asymmetric hearing losses. In various applications, the acoustic scene is assumed to be stationary in the time interval referred to as "long term". The corresponding long-term parameters may be updated and communicated between the hearing aids on the order of seconds. In various applications, the long-term parameters are used to capture changes between different acoustic scenes (or listening environments). The "long term" may refer to a time interval between 1 and 60 seconds. In various applications, the short-term level and SNR are used to capture the temporal variations of most speech and fluctuating noise sound sources. The corresponding short-term parameters may be updated and communicated between the hearing aids on the order of frames. In various applications, the "short term" may refer to a time interval preferably at syllable levels, such as between 10 and 100 milliseconds. Other timings may be used without departing from the scope of the present subject matter.

In one example embodiment, the acoustic scene is characterized in terms of the long-term (broadband) SNRs at the left and right ears. The SNRs can be measured based on the amplitude modulation depth of the signal. A binaural-noise-reduction method may be used to compute and compare the SNR at two ears. In one such embodiment, a binaural noise reduction method is provided, such as in International Publication No. WO 2010022456A1, however, it is understood that other binaural noise reduction methods may be employed without departing from the scope of the present subject matter.

In sparse scenarios with only few talkers present, directional microphones may be used to estimate SNRs assuming that the target is located in front (compare to Boldt, J. B, Kjems, U., Pederson, M. S., Lunner, T., and Wang, D. (2008). "Estimation of the ideal binary mask using directional systems," Proceedings of the 11th International Workshop on Acoustic Echo and Noise Control, Seattle, Wash.). The scope of the present subject matter is not limited to specific methods for SNR estimation.

In one example embodiment, the acoustic scene is characterized in terms of the long-term (broadband) SNRs at the left and right ears ($SNR_l$ and $SNR_r$), and short-term (band-limited) levels at the two ears ($L_{lc}[n]$ and $L_{rc}[n]$, where the "n" represents the frame index, "c" the channel index) are measured. Methods 210, 318, and 440 are performed as follows (with $SNR_l$ and $SNR_r$ corresponding to $SNR_1$ and $SNR_2$, $L_l$ and $L_r$ corresponding to the levels of the first audio signal and the second audio signal, and values for various thresholds provided as examples only). Though frames are referenced as a specific example for the purpose of illustration, it is understood various processing methods with or without using frames may be employed without departing from the scope of the present subject matter.

If the minimum of $SNR_l$ and $SNR_r$ is greater than 15 dB, a single-source environment is indicated, with a single sound source in front or on one side of the listener wearing a pair of left and right hearing aids. Independent dynamic range compression is used in the left and right hearing aids. This approach reduces or minimizes power consumption.

If the minimum of $SNR_l$ and $SNR_r$ is not greater than 15 dB, multiple sound sources such as multiple talkers are indicated. Coordinated dynamic range compression is used, i.e., the common short-term gain is applied in both the left and right hearing aids. The gains are coordinated in various ways depending on whether the acoustic scenario (distribution of sound sources) is symmetric or asymmetric around the midline between the left and right hearing aids. In the symmetric environment, spatial fidelity is preserved, and the maximally possible gain is applied while not producing uncomfortably loud signals. In the asymmetric environment, better-ear listening is supported in addition to preserving spatial fidelity. When the level of the better-ear signal is low and the short-term SNR is positive, the better-ear gain is chosen to be the common gain in order to ensure that the signal stays above threshold. When the level is high or when the signal is dominated by noise (negative short-term SNR in the better ear), the minimum gain is chosen in order to reduce interference in the better ear.

If $SNR_l$ and $SNR_r$ approximately equal, such as when their difference is within a certain limit (e.g., 3 dB), the symmetric environment is indicated. One example of the symmetric environment includes a target talker in front of the listener, with diffuse noise or with two interfering talkers (of comparable sound level) on the sides of the listener. Another example of the symmetric environment includes two talkers of comparable sound levels on the left and right sides of the listener, without a talker in front of the listener. The short-term levels ($L_{lc}[n]$ and $L_{rc}[n]$) are measured at the two ears. If the maximum of $L_{lc}[n]$ and $L_{rc}[n]$ is less than a specified $UCL_c$ (Uncomfortable Listening Level) subtracted by the maximum prescribed gain for tones, a maximum gain (the maximum of the gains applied in the left and right hearing aids) is chosen to be the common gain based on the minimum of $L_{lc}[n]$ and $L_{rc}[n]$. If the maximum of $L_{lc}[n]$ and $L_{rc}[n]$ is not less than a specified $UCL_c$ subtracted by the maximum prescribed gain, a minimum gain (the minimum of the gains applied in the left and right hearing aids) is chosen to be the common gain based on the maximum of $L_{lc}[n]$ and $L_{rc}[n]$. This approach prevents uncomfortably loud sounds to be delivered to the listener.

If $SNR_l$ and $SNR_r$ are not approximately equal, such as when their difference exceeds certain limit (e.g., 3 dB), the asymmetric environment is indicated. One example of the asymmetric environment includes a target talker on one side of the listener, with diffuse noise or with noise on the other side of the listener. Another example of the asymmetric environment includes a target talker on one side of the listener, with interfering talker(s) (different in sound level) on the other side of the listener. Yet another example of the asymmetric environment includes a target talker in front of the listener, with noise or interfering talker(s) on one side of the listener. One of the left and right hearing aids with the higher SNR is chosen as the "better-ear" device (or "B" device). The other of the left and right hearing aids is consequently the "worse-ear" device (or "W" device). The short-term SNR is measured in the "better-ear" device ($SNR_{Bc}[n]$) and the short-term level is measured in both ears ($L_{Bc}[n]$ and $L_{Wc}[n]$). If $L_{Bc}[n]$ in dB SL is greater than 10 (i.e., if the unaided signal is audible), the minimum gain is chosen to be the common gain based on maximum of $L_{Bc}[n]$ and $L_{Wc}[n]$. By doing so, the gains of the better-ear device are reduced when the better-ear signal is dominated by noise. If $L_{Bc}[n]$ in dB SL is not greater than 10, and $SNR_{Bc}[n]$ is greater than 0, (i.e., if the frame contains low-level signal components), the better-ear gain is chosen to be the common gain based on the level in the better ear ($L_{Bc}[n]$) to ensure audibility. If $L_{Bc}[n]$ in dB SL is not greater than 10, but $SNR_{Bc}[n]$ is not greater than 0 (i.e., frame dominated by noise), the minimum gain is chosen to be the common gain based on maximum of $L_{Bc}[n]$ and $L_{Wc}[n]$.

It is understood that other approaches may be employed. In one embodiment, the system switches in a binary fashion between minimum and maximum gain. In various embodiments, continuous interpolation between minimum and maximum gain is employed. In one embodiment, the coordination is performed in each frame. In various embodiments, the coordination is performed in decimated frames (e.g., the above frame index "n" would refer to decimated frames). For example, the short-term levels would be communicated only for every four frames.

In various embodiments, compression is independently coordinated in each channel of a multichannel hearing aid. In various embodiments, the coordination is performed in augmented channels (e.g., the above channel index "c" would then refer to augmented channels). For example, for a 16-channel aid, the short-term levels would be communicated only for three augmented channels (0-1 kHz, 1-3 kHz, and 3-8 kHz). In various embodiments, the coordination is performed only for high-frequency channels.

Figure 5:
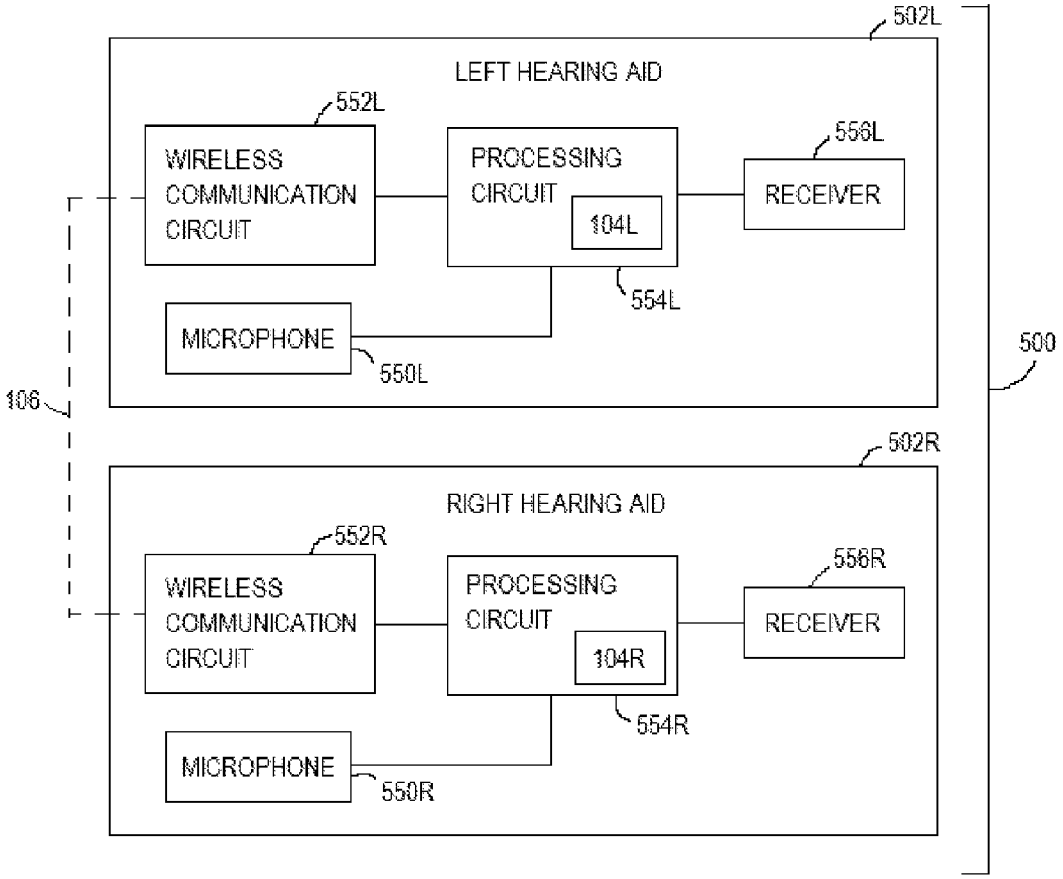
FIG. 5 is a block diagram illustrating another embodiment of the hearing assistance system.

FIG. 5 is a block diagram illustrating an embodiment of a hearing assistance system 500 representing an embodiment of hearing assistance system 100 and including a left hearing aid 502L and a right hearing aid 502R. Left hearing aid 502L includes a microphone 550L, a wireless communication circuit 552L, a processing circuit 554L, and a receiver (also known as a speaker) 556L. Microphone 550L receives sounds from the environment of the listener (hearing aid wearer) and produces a left audio signal (one of the first and second audio signals discussed above) representing the received sounds.

Wireless communication circuit 552L wirelessly communicates with right hearing aid 502R via binaural link 106. Processing circuit 554L includes first portions 104L of control circuitry 104 and processes the left audio signal. Receiver 556L transmits the processed left audio signal to the left ear of the listener.

Right hearing aid 502R includes a microphone 550R, a wireless communication circuit 552R, a processing circuit 554R, and a receiver (also known as a speaker) 556R. Microphone 550R receives sounds from the environment of the listener and produces a right audio signal (the other of the first and second audio signals discussed above) representing the received sounds. Wireless communication circuit 552R wirelessly communicates with left hearing aid 502L via binaural link 106. Processing circuit 554R includes second portions 104R of control circuitry 104 and processes the right audio signal. Receiver 556R transmits the processed right audio signal to the right ear of the listener.

The hearing aids 502L and 502R are discussed as examples for the purpose of illustration rather than restriction. It is understood that binary link 106 may include any type of wired or wireless link capable of providing the required communication in the present subject matter. In various embodiments, hearing aids 502L and 502R may communicate with each other via any wired and/or wireless couple.

It is understood that the hearing aids referenced in this patent application include a processor (such as processing circuits 104L and 104R). The processor may be a digital signal processor (DSP), microprocessor, microcontroller, or other digital logic. The processing of signals referenced in this application can be performed using the processor. Processing may be done in the digital domain, the analog domain, or combinations thereof. Processing may be done using subband processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

The methods illustrated in this disclosure are not intended to be exclusive of other methods within the scope of the present subject matter. Those of ordinary skill in the art will understand, upon reading and comprehending this disclosure, other methods within the scope of the present subject matter. The above-identified embodiments, and portions of the illustrated embodiments, are not necessarily mutually exclusive.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for operating a hearing aid set including a first hearing aid and a second hearing aid, the method comprising:

performing a first dynamic range compression including applying a first gain to a first audio signal in the first hearing aid;

performing a second dynamic range compression including applying a second gain to a second audio signal in the second hearing aid;

detecting an acoustic scene; and controlling the first dynamic range compression and the second dynamic range compression using the detected acoustic scene, such that the first dynamic range compression and the second dynamic range compression are performed independently in response to the detected acoustic scene indicating a single sound source, and the first dynamic range compression and the second dynamic range compression are coordinated, in response to the detected acoustic scene indicating a plurality of sound sources, using a distribution of sound sources of the plurality of sound sources indicated by the detected acoustic scene.

2. The method of claim 1, wherein detecting the acoustic scene comprises:

determining a first signal-to-noise ratio ($SNR_1$) of the first audio signal;

determining a second signal-to-noise ratio ($SNR_2$) of the second audio signal;

determining whether a minimum of $SNR_1$ and $SNR_2$ exceeds a threshold SNR;

declaring that the detected acoustic scene indicates the single sound source in response to the minimum of $SNR_1$ and $SNR_2$ exceeding the threshold SNR; and declaring that the detected acoustic scene indicates the plurality of sound sources in response to the minimum of $SNR_1$ and $SNR_2$ not exceeding the threshold SNR.

3. The method of claim 2, wherein the threshold SNR is about 15 dB.

4. The method of claim 1, wherein controlling the first dynamic range compression and the second dynamic range compression comprises controlling the first gain and the second gain independently in response to the detected acoustic scene indicating the single sound source and setting the first gain and the second to a common gain in response to the detected acoustic scene indicating the plurality of sound sources.

5. The method of claim 4, comprising determining the common gain based on the distribution of the sound sources indicated by the detected acoustic scene.

6. The method of claim 5, comprising:

determining a first signal-to-noise ratio ($SNR_1$) of the first audio signal;

determining a second signal-to-noise ratio ($SNR_2$) of the second audio signal;

determining a difference between $SNR_1$ and $SNR_2$;

comparing the difference between $SNR_1$ and $SNR_2$ to a specified margin;

declaring that the distribution of the sound sources is substantially symmetric in response to the difference between $SNR_1$ and $SNR_2$ being within the specified margin;

declaring that the distribution of the sound sources to be substantially asymmetric in response to the difference between $SNR_1$ and $SNR_2$ exceeding the specified margin; and determining the common gain based on whether the distribution of the sound sources is substantially symmetric or substantially asymmetric.

7. The method of claim 6, wherein the specified margin is about 3 dB.

8. The method of claim 5, comprising applying a maximum gain while not producing uncomfortably loud signals in response to the detected acoustic scene indicating the distribution of the sound sources being substantially symmetric.

9. The method of claim 5, comprising selecting a better-ear signal from the first audio signal and the second audio signal and applying the common gain that supports better-ear listening in response to the detected acoustic scene indicating the distribution of the sound sources being substantially asymmetric.

10. The method of claim 9, comprising:

determining a level of the better-ear signal;

comparing the level of the better-ear signal to a threshold level;

determining a SNR of the better-ear signal;

determining whether the SNR is positive or negative; and setting the common gain to a better-ear gain in response to the level of the better-ear signal being below the threshold level and the SNR of the better-ear signal being positive, the better-ear gain being one of the first and second gains applied to the one of the first and second signals being selected to be the better-ear signal.

11. The method of claim 10, comprising setting the common gain to a minimum of the first and second gains in response to the level of the better-ear signal exceeding the threshold level and the SNR of the better-ear signal being negative.

12. The method of claim 11, wherein the threshold level is about 10 dB sensation level.

13. A hearing assistance system for use by a listener, comprising;

a first hearing aid configured to receive a first audio signal and perform first dynamic range compression of the first audio signal;

a second hearing aid configured to receive a second audio signal and perform a second dynamic range compression of the second audio signal; and control circuitry included in the first and second hearing aids, the control circuitry configured to:

detect an acoustic scene using the first and second audio signals; and control the first dynamic range compression and the second dynamic range compression using the detected acoustic scene, such that the first dynamic range compression and the second dynamic range compression are performed independently in response to the detected acoustic scene indicating a single sound source, and the first dynamic range compression and the second dynamic range compression are coordinated, in response to the detected acoustic scene indicating a plurality of sound sources, using a distribution of sound sources of the plurality of sound sources indicated by the detected acoustic scene.

14. The system of claim 13, wherein the first hearing aid comprises:

a first microphone configured to produce the first audio signal;

a first communication circuit configured to communicate with the second hearing aid;

a first processing circuit including first portions of the control circuitry and configured to process the first audio signal including performing the first dynamic range compression; and a first receiver configured to deliver the processed first audio signal to the listener, and the second hearing aid comprises:

a second microphone configured to produce the second audio signal;

a second communication circuit configured to communicate with the first hearing aid;

a second processing circuit including second portions of the control circuitry and configured to process the second audio signal including performing the second dynamic range compression; and a second receiver configured to deliver the processed second audio signal to the listener.

15. The system of claim 13, wherein the control circuitry is configured to:

determine a first signal-to-noise ratio ($SNR_1$) of the first audio signal;

determine a second signal-to-noise ratio ($SNR_2$) of the second audio signal; and declare either that the detected acoustic scene indicates the single sound source or that the detected acoustic scene indicates the plurality of sound sources based on $SNR_1$ and $SNR_2$.

16. The system of claim 15, wherein the control circuitry is configured to a first gain to the first audio signal and a second gain to the second audio signal, set the first gain and the second gain independently in response to the detected acoustic scene indicating the single sound source, and set the first gain and the second to a common gain in response to the detected acoustic scene indicating the plurality of sound sources.

17. The system of claim 16, wherein the control circuitry is configured to determine the common gain based on the distribution of the sound sources indicated by the detected acoustic scene.

18. The system of claim 17, wherein the control circuitry is configured to apply a maximum gain while not producing uncomfortably loud signals in response to the detected acoustic scene indicating the distribution of the sound sources being substantially symmetric.

19. The system of claim 18, wherein the control circuitry is configured to select a better-ear signal from the first audio signal and the second audio signal and apply the common gain that supports better-ear listening in response to the detected acoustic scene indicating the distribution of the sound sources being substantially asymmetric.

20. The system of claim 19, wherein the control circuitry is configured to:

determining a first signal-to-noise ratio ($SNR_1$) of the first audio signal;

determining a second signal-to-noise ratio ($SNR_2$) of the second audio signal; and declaring either that the distribution of the sound sources is substantially symmetric or that the distribution of the sound sources to be substantially asymmetric based on $SNR_1$ and $SNR_2$.

21. The system of claim 20, wherein the control circuitry is configured to:

determine a level of the better-ear signal;

compare the level of the better-ear signal to a threshold level;

determine a signal-to-noise ratio (SNR) of the better-ear signal;

determine whether the SNR is positive or negative; and set the common gain to a better-ear gain in response to the level of the better-ear signal being below the threshold level and the SNR of the better-ear signal being positive, the better-ear gain being one of the first and second gains applied to the one of the first and second signals being selected to be the better-ear signal.

22. The system of claim 21, wherein the control circuitry is configured to set the common gain to a minimum of the first and second gains in response to the level of the better-ear signal exceeding the threshold level and the SNR of the better-ear signal being negative.

* * * * *

UNITED STATES PATENT AND TRADEMARK OFFICE

CERTIFICATE OF CORRECTION

PATENT NO. : 8,971,557 B2
APPLICATION NO. : 13/962762
DATED : March 3, 2015
INVENTOR(S) : Xia et al.

It is certified that error appears in the above-identified patent and that said Letters Patent is hereby corrected as shown below:

On the Title page, item (72), in "Inventors", in column 1, line 2, delete "Oakland, CA" and insert --Loveland, OH--, therefor In the Claims In column 11, line 46-47, in Claim 13, delete "comprising;" and insert --comprising:--, therefor Signed and Sealed this
Tenth Day of November, 2015

Michelle K. Lee

Michelle K. Lee
*Director of the United States Patent and Trademark Office*